US007192251B1

(12) United States Patent
Boury et al.

(10) Patent No.: US 7,192,251 B1
(45) Date of Patent: Mar. 20, 2007

(54) AIR DEFLECTOR FOR A COOLING CIRCUIT FOR A GAS TURBINE BLADE

(75) Inventors: Jacques Auguste Amedee Boury, Saint Ouen en Brie (FR); Patrice Eneau, Moissy Cramayel (FR); Guy Moreau, Yerres (FR)

(73) Assignee: SNECMA, Paris (FR)

( * ) Notice: Subject to any disclaimer, the term of this patent is extended or adjusted under 35 U.S.C. 154(b) by 0 days.

(21) Appl. No.: 11/466,660

(22) Filed: Aug. 23, 2006

(30) Foreign Application Priority Data

Aug. 25, 2000 (FR) ..... 05 08740

(51) Int. Cl.
*F01D 5/18* (2006.01)

(52) U.S. Cl. ..... 416/97 R

(58) Field of Classification Search ..... 415/115–116; 416/96 R, 96 A, 97 R
See application file for complete search history.

(56) References Cited

U.S. PATENT DOCUMENTS 3,171,631 A 3/1965 Aspinwall
4,180,373 A * 12/1979 Moore et al. ..... 416/97 R
4,775,296 A 10/1988 Schwarzmann et al.
5,738,493 A 4/1998 Lee et al.
5,779,438 A 7/1998 Wilfert
2003/0044278 A1 3/2003 Eneau et al.
2005/0025623 A1 2/2005 Botrel et al.
2005/0058546 A1 3/2005 Cooper

FOREIGN PATENT DOCUMENTS

DE 195 26 917 A1 1/1997

* cited by examiner

*Primary Examiner*—Christopher Verdier
(74) *Attorney, Agent, or Firm*—Oblon, Spivak, McClelland, Maier & Neustadt, P.C.

(57) ABSTRACT

A gas turbine blade comprising an internal cooling circuit consisting of at least one cavity extending radially between the base and tip of the blade, at least one air inlet aperture at one radial end of the cavity and at least one air outlet orifice opening into the cavity and emerging onto one of the faces of the blade. At least one of the walls of the cavity of the cooling circuit comprises at least one air deflector whereof the shape and dimensions are adapted to project the air flowing along the wall of the cavity towards an opposite wall of the cavity whilst avoiding re-attachment of the boundary layer immediately downstream of the air deflector.

10 Claims, 3 Drawing Sheets

AIR DEFLECTOR FOR A COOLING CIRCUIT FOR A GAS TURBINE BLADE

BACKGROUND OF THE INVENTION

The present invention relates to the general field of the cooling of gas turbine blades, in particular the movable blades of a turbine engine gas turbine.

The gas turbine blades of a turbine engine, such as the movable blades of the high-pressure turbine for example, are subjected to the very high temperatures of the gases coming from the combustion chamber. These temperatures reach values considerably higher than those that the blades of the turbine can withstand without damage, the result of which is to limit their service life.

To remedy this problem, providing these blades with internal cooling circuits is well known. By virtue of such cooling circuits, air, which is generally introduced into the blade via its base, passes through it following a route formed by cavities made in the blade before being ejected via apertures opening at the surface of the blade.

There are many different implementations of these cooling circuits. Thus, some circuits use cooling cavities that occupy the entire width of the blade (that is to say extend from the concave side to the convex side of the blade). Other circuits propose the use of edge cooling cavities occupying only a single side of the blade (concave side or convex side) or both sides with the addition of a large central cavity between these edge cavities.

In terms of mechanical strength, a gas turbine blade exhibits a good service life if its concave side and convex side faces have neighboring temperatures (that is to say if the thermal gradient between these faces is small). Furthermore, irrespective of the method of implementing the cooling circuits, the internal cooling of a turbine blade is provided by internal convection of a flow of fresh air over the walls of the cavities forming these circuits. The result of this is a different heat exchange on each wall of the cavity, independently of whether this is smooth or disrupted or whether the blade is fixed or movable.

However, the heat exchange with the hot gases circulating outside the blade is greater on the concave side than on the convex side of the blade. Consequently, in order to compensate for this phenomenon and thus obtain a small thermal gradient between the concave side and convex side faces of the blade, it is necessary to greatly cool the internal walls of the cavities of the cooling circuit which are disposed on the concave side of the blade.

For a movable gas turbine blade, when the flow of air in the cavities of the cooling circuit is centrifugal, and despite the effects of the Coriolis force which increase the heat exchanges internal to the concave side of the blade, the difference with the heat exchanges taking place at the convex side of the blade remains too great to obtain a small thermal gradient. Similarly, when the flow of air in the cavities of the cooling circuit of the movable blade is centripetal, the heat exchange naturally favors the convex side of the blade, which further increases the temperature difference between the concave side and convex side faces of the blade.

OBJECT AND SUMMARY OF THE INVENTION

The main aim of the present invention is therefore to overcome such drawbacks by proposing a gas turbine blade for which the internal cooling circuit makes it possible to minimize the temperature difference between the concave side and convex side faces thereof.

To that end, a gas turbine blade is provided that comprises an internal cooling circuit consisting of at least one cavity extending radially between the base and tip of the blade, at least one air inlet aperture at one radial end of the cavity and at least one air outlet orifice opening into the cavity and emerging onto one of the faces of the blade, wherein at least one of the walls of said cavity of the cooling circuit comprises at least one air deflector whereof the shape and dimensions are adapted to project the air flowing along said wall of the cavity towards an opposite wall of said cavity whilst avoiding re-attachment of the boundary layer immediately downstream of said air deflector.

By judiciously positioning the air deflector in the cavity of the cooling circuit according to whether the flow therein is centrifugal or centripetal, it is possible to project the air circulating in the cavity towards the wall of the cavity which is disposed on the concave side of the blade. Thus, such an air deflector makes it possible to increase the heat exchange internal to the concave side of the blade and therefore reduce the thermal gradient between the convex side and concave side walls of the cavity of the cooling circuit. In that way, any temperature difference between the concave side and convex side faces of the blade can be avoided.

According to an advantageous provision of the invention, the air deflector has an inclined ramp so as to project the air flowing along the wall of the cavity towards the opposite wall. Such a ramp can have a length of between 2 and 4 times its height and have a radius of curvature of between 20 and 30 mm.

According to a particular application of the invention, the inclined ramp of the air deflector has a height corresponding to approximately 37.5% of the distance separating the two opposite walls of the cavity of the cooling circuit.

According to a particular application of the invention, the wall of the cavity of the cooling circuit comprising the air deflector can be disposed on the convex side of the blade and the wall of the cavity onto which the air is projected can be disposed on the concave side of the blade.

When the flow of air in the cavity of the cooling circuit is centrifugal, the air deflector is advantageously disposed on the wall of the cavity of the cooling circuit in the region of an attachment zone of the blade.

Alternatively, when the flow of air in the cavity of the cooling circuit is centripetal, the air deflector is advantageously disposed on the wall of the cavity of the cooling circuit in the region of the tip of the blade.

According to yet another alternative for which the cooling circuit comprises at least two cavities, the air deflector can be positioned in the region of a passage connecting the radial end of one of the cavities with a neighboring radial end of the other cavity.

Another object of the invention is a gas turbine and a turbine engine having a plurality of blades as defined previously.

BRIEF DESCRIPTION OF THE DRAWINGS

Other characteristics and advantages of the present invention will emerge from the description given below, with reference to the accompanying drawings that illustrate an example embodiment thereof without any limiting character. In the figures.

DETAILED DESCRIPTION OF ONE EMBODIMENT

Figure 1:
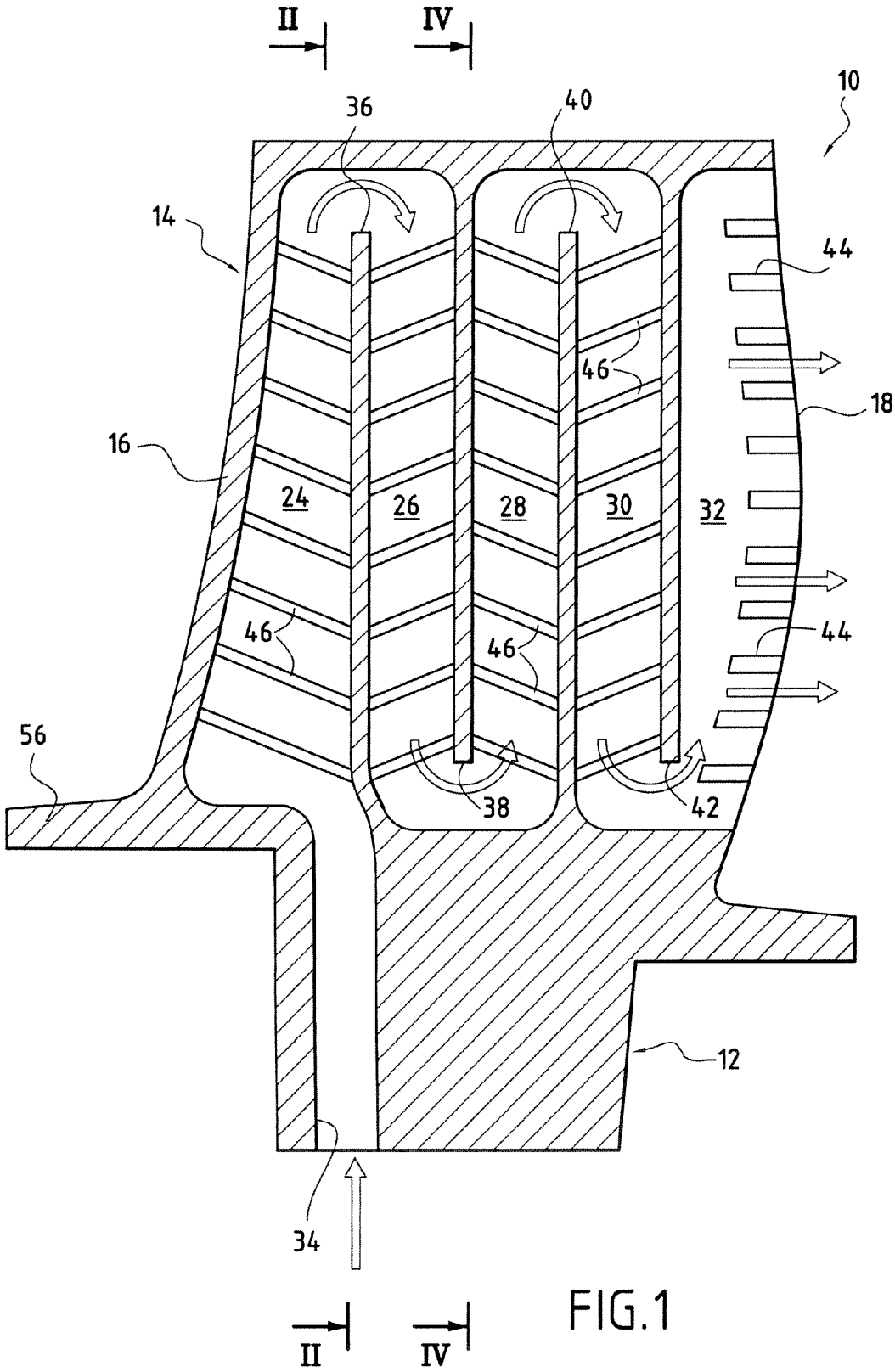
FIG. 1 is a view in longitudinal section of a movable gas turbine blade according to one embodiment of the invention.

FIGS. 1 to 4 depict a movable turbine engine blade 10, such as a movable high-pressure turbine blade. Of course, the invention can equally well apply to other movable blades of a turbine engine gas turbine, as well as to fixed blades of a turbine engine gas turbine.

The blade 10 comprises an aerodynamic surface (or vane) that extends radially between a blade base 12 and a blade tip 14. This aerodynamic surface consists of a leading edge 16 disposed facing the flow of hot gases originating from the combustion chamber of the turbine engine, a trailing edge 18 opposite to the leading edge 16, a concave side lateral face 20 and a convex side lateral face 22, these lateral faces 20, 22 connecting the leading edge 16 to the trailing edge 18.

The blade 10 is provided with an internal cooling circuit of the type formed by at least one cavity extending radially between the base 12 and the tip 14 of the blade, at least one air inlet aperture at one radial end of the cavity and at least one air outlet orifice opening into the cavity and emerging onto one of the faces of the blade.

In the example embodiment of FIGS. 1 to 4, the internal cooling circuit of the blade consists of a leading edge cavity 24 disposed on the leading edge 16 side of the blade, three central cavities 26, 28 and 30 disposed in a central part of the blade and a trailing edge cavity 32 disposed on the trailing edge 18 side of the blade. These various cavities 24, 26, 28, 30 and 32 extend from the concave side face 20 to the convex side face 22 of the blade.

An air inlet aperture 34 is provided at one radial end of the leading edge cavity 24 (here at the base 12 of the blade) in order to supply the cooling circuit with air.

A first passage 36 connects the other radial end of the leading edge cavity 24 with a neighboring radial end of the adjacent central cavity 26. A second passage 38 and a third passage 40 respectively connect the central cavity 26 with the adjacent central cavity 28 and the latter with the remaining central cavity 30. Finally, a fourth passage 42 connects the central cavity 30 with the trailing edge cavity 32.

The concave side cooling circuit also comprises output orifices 44 opening into the trailing edge cavity 32 and emerging onto the concave side face 20 of the blade in the region of the trailing edge 18 thereof. These orifices 44 are distributed regularly over the entire radial height of the blade.

Air flow disrupters 46 intended to increase the heat transfers can be provided along the walls of the various cavities 24, 26, 28, 30 and 32 of the cooling circuit. These flow disrupters 46 can come in the form of ribs that are straight or inclined with respect to the axis of rotation of the blade, in the form of spikes or in any other equivalent form.

Of course, any other embodiment of the internal cooling circuit of the blade of the type described previously is applicable to the invention. In particular, the number, shape and disposition of the cavities, as well as the quantity and disposition of the air inlet orifices, the connecting passages and the outlet orifices, can vary according to the cooling circuit.

According to the invention, at least one of the walls of one (or more) of the cavities 24, 26, 28, 30 and 32 of the cooling circuit comprises at least one air deflector 48, 48'.

Figure 2:
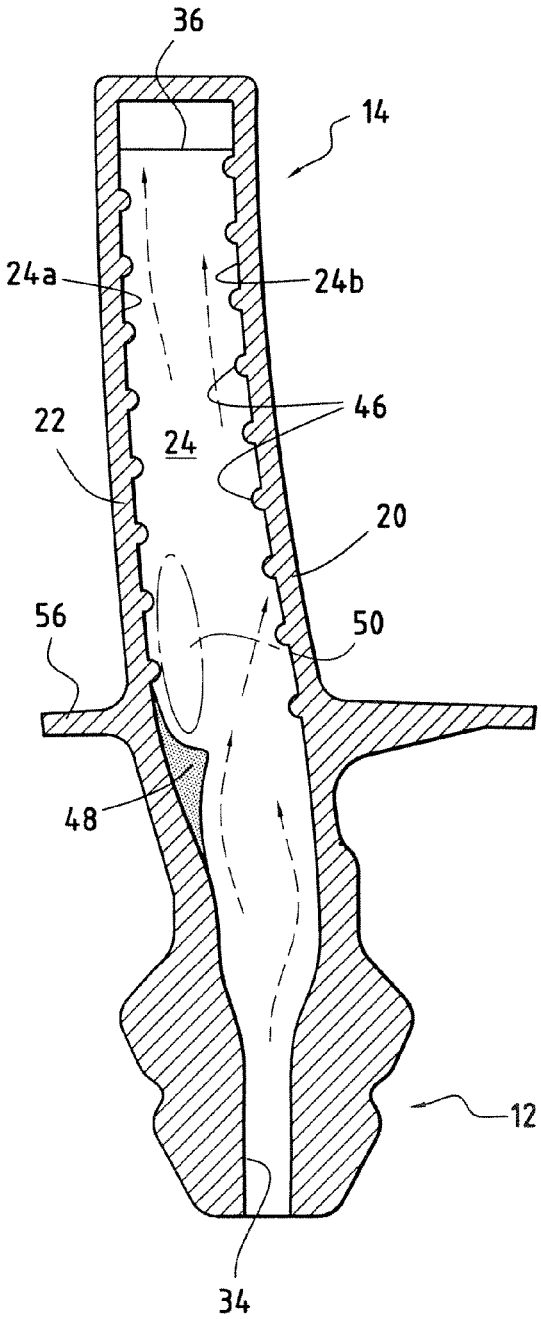
FIG. 2 is a sectional view along II—II of FIG. 1.
Figure 3:
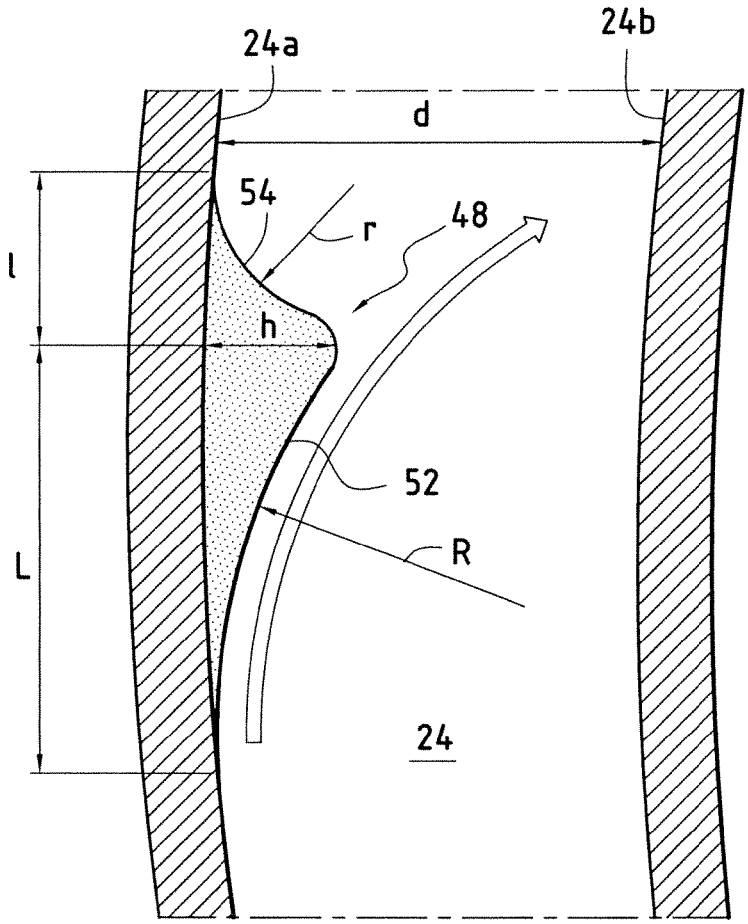
FIG. 3 is an enlargement of a detail of FIG. 2.

An example location of such an air deflector 48 can in particular be seen in FIGS. 2 and 3. In these figures, the air deflector 48 is positioned on the wall 24*a* of the leading edge cavity 24 which is disposed on the convex side 22 of the blade.

Figure 4:
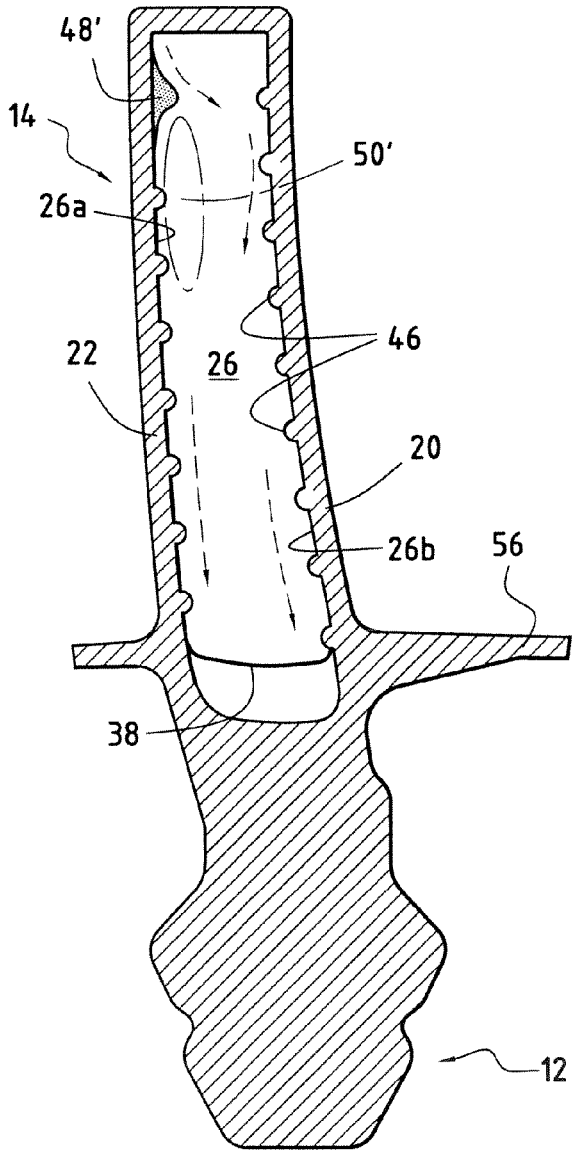
FIG. 4 is a sectional view along IV—IV of FIG. 1.

Another example location of such an air deflector 48' is depicted in FIG. 4. In this figure, the air deflector 48' is disposed on the wall 26*a* of the central cavity 26 adjacent to the leading edge cavity 24 which is disposed on the convex side 22 of the blade.

Still according to the invention, the shape and dimensions of the air deflector 48, 48' are adapted to project the air flowing along the wall 24*a*, 26*a* of the cavity 24, 26 towards an opposite wall 24*b*, 26*b* of the cavity whilst avoiding re-attachment of the boundary layer immediately downstream of the air deflector.

By re-attachment of the boundary layer immediately downstream of the air deflector 48, 48', it is necessary to understand that the air downstream of the deflector flows mainly along the wall 24*b*, 26*b* opposite to the wall 24*a*, 26*a* on which the air deflector is installed. Consequently, in the zone 50, 50' immediately downstream of the air deflector 48, 48', the flow of air along the wall 24*a*, 26*a* where the deflector is located is small. By way of example, this zone 50, 50' of small air flow extends over a radial height of the blade of the order of approximately 20% of the total radial height of the blade.

Compared with the air flow disrupters that are used to increase heat transfers, the air deflector according to the invention is distinguished in that it consists, on the one hand, of projecting the air onto the wall opposite to the one where it is installed and, on the other hand, of avoiding an immediate re-attachment of the boundary layer. On the other hand, an air flow disrupter has the essential function of increasing the turbulence of the air flow in the immediate vicinity of the disrupter whilst seeking to re-attach the flow downstream thereof. As depicted in FIGS. 1 to 4, the presence of air flow disrupters 46 with the air deflector 48, 48' according to the invention is moreover not incompatible.

FIG. 3 depicts more precisely an embodiment of an air deflector 48 according to the invention.

The air deflector 48 comprises a ramp 52 that is inclined with respect to the wall 24*a* of the cavity 24 on which the deflector is installed so as to project the air flowing along this wall 24*a* towards the opposite wall 24*b*.

Advantageously, the inclined ramp 52 of the air deflector 48 has a length L that is between 2 and 4 times its height h. For example, for a cooling cavity 24 having a width d (that is to say the distance separating its walls 24*a*, 24*b*) of the order of 4 mm, the ramp 52 of the air deflector 48 has a height h of the order of 1.5 mm and a length L of between 3 and 5 mm. By way of comparison, for a cooling cavity 24 having a width d of the order of 3 mm, an air flow disrupter 46 as described previously has a height of between 0.4 and 0.5 mm.

Still advantageously, the inclined ramp 52 of the air deflector 48 is rounded and has a radius of curvature R of between 20 and 30 mm. This value is given by way of example for a cooling cavity 24 having a width d of the order of 4 mm. A radius of curvature R so large with respect to the width d of the cavity 24 makes it possible to move the air flowing along the wall 24*a* towards the opposite wall 24*b* without accelerating it suddenly. It should also be noted that the radius of curvature R of the ramp 52 of the deflector is preferably greater than the length L over which this ramp extends.

On the side opposite to the inclined ramp 52, the air deflector 48 has another rounded ramp 54 whereof the radius of curvature r and the length I over which it extends are calculated so as to avoid re-attachment of the boundary layer immediately downstream of the air deflector. In particular, the radius of curvature r of this other ramp 54 must be as small as possible to achieve this aim.

In the example embodiment of FIGS. 1 to 3, the flow of air in the leading edge cavity 24 is centrifugal, that is to say the air flows from the base 12 towards the tip 14 of the blade. In this type of flow, the air deflector 48 is advantageously disposed on the wall of the cavity 24 of the cooling circuit in the region of an attachment zone of the blade. This attachment zone extends from the radial end of the blade situated on its base 12 side to a platform 56 delimiting the inner wall of the stream of flow of gases passing through the gas turbine. Such a location of the air deflector makes it possible to obtain an optimum internal heat exchange at the concave side of the blade.

In the example embodiment of FIG. 4, the flow of air in the central cavity 26 is centripetal, that is to say the air flows from the tip 14 towards the base 12 of the blade. In this type of flow, the air deflector 48' is advantageously disposed on the wall of the cavity 26 of the cooling circuit in the region of the tip 14 of the blade. Such a location makes it possible to obtain an optimum internal heat exchange at the concave side of the blade.

Furthermore, it should be noted that the shape and dimensions of the air deflector 48' of this embodiment depicted by FIG. 4 are identical to those described in conjunction with FIGS. 1 to 3.

Figure 5:
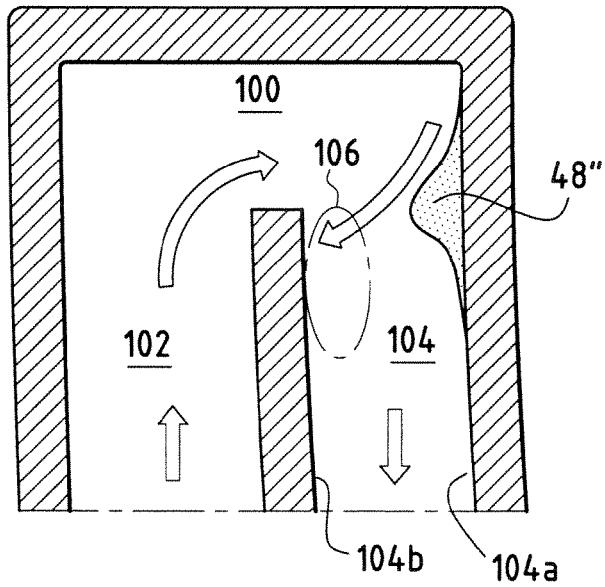
FIG. 5 is a partial view in longitudinal section of a movable gas turbine blade according to another embodiment of the invention.

In conjunction with FIG. 5, a description will now be given of another example location of an air deflector 48" according to the invention.

In this embodiment, the air deflector 48" is positioned in the region of a passage 100 connecting the radial end of a cavity 102 of an internal cooling circuit of a blade with a neighboring radial end of another cavity 104 that is adjacent to it. Such a connecting passage 100 can, for example, be one of the passages 36 to 40 of the blade of FIGS. 1 to 3.

The air deflector 48" is disposed on one of the walls 104*a* of the cavity 104 and its shape and dimensions are adapted to project the air flowing along this wall 104*a* towards the opposite wall 104*b* whilst avoiding re-attachment of the boundary layer immediately downstream of the air deflector.

More precisely, the air deflector 48" is positioned so that the air circulating in the cavity 102 is projected in the region where it "turns round" into the adjacent cavity 104 (that is to say in the region of the connecting passage 100) towards an air circulation zone 106 that is situated in the region of the radial end of the opposite wall 104*b* of the adjacent cavity 104. Such a zone 106 is usually a zone in which the air circulation is small and not disrupted.

In this example embodiment, the air deflector 48" therefore makes it possible to avoid any risk of detachment of the boundary layer in the region of the zone between the two cavities 102, 104 of the cooling circuit where the air "turns round".

The invention claimed is:

1. A gas turbine blade comprising an internal cooling circuit consisting of at least one cavity extending radially between the base and tip of the blade, at least one air inlet aperture at one radial end of the cavity and at least one air outlet orifice opening into the cavity and emerging onto one of the faces of the blade, at least one of the walls of said cavity of the cooling circuit comprising at least one air deflector whereof the shape and dimensions are adapted to project the air flowing along said wall of the cavity towards an opposite wall of said cavity whilst avoiding re-attachment of the boundary layer immediately downstream of said air deflector, wherein the air deflector has an inclined ramp that has a length (L) of between 2 and 4 times its height (h) so as to project the air flowing along the wall of the cavity towards the opposite wall.

2. The blade as claimed in claim 1, wherein the inclined ramp of the air deflector has a radius of curvature (R) of between 20 and 30 mm.

3. The blade as claimed in claim 1, wherein the inclined ramp of the air deflector has a height (h) corresponding to approximately 37.5% of the distance separating the two opposite walls of the cavity of the cooling circuit.

4. The blade as claimed in claim 1, wherein the wall of the cavity of the cooling circuit comprising the air deflector is disposed on a convex side of the blade and the wall of said cavity onto which the air is projected is disposed on a concave side of the blade.

5. The blade as claimed in claim 1, wherein the air deflector is disposed on the wall of the cavity of the cooling circuit in the region of an attachment zone of the blade.

6. The blade as claimed in claim 1, wherein the air deflector is disposed on the wall of the cavity of the cooling circuit in the region of the tip of the blade.

7. The blade as claimed in claim 1, wherein the internal cooling circuit comprises at least two cavities, the air deflector being positioned in the region of a passage connecting the radial end of one cavity with a neighboring radial end of the other cavity.

8. The blade as claimed in claim 1, wherein the walls of the cavity of the cooling circuit are provided with a plurality of flow disrupters intended to increase the heat transfers along these walls.

9. A gas turbine comprising a plurality of blades as claimed in claim 1.

10. A turbine engine comprising a gas turbine having a plurality of blades as claimed in claim 1.

* * * * *